United States Patent [19]

Scharf et al.

[11] 4,229,409

[45] Oct. 21, 1980

[54] METHOD OF INHIBITING CORROSION OF ALUMINUM WITH 2-PHOSPHONO-BUTANE-1,2,4-TRICARBOXYLIC ACID

[75] Inventors: Rolf Scharf, Monheim; Hans-Joachim Schlüssler, Haan; Friedrich Staschkiewicz, Monheim-Baumberg, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 956,897

[22] Filed: Nov. 2, 1978

Related U.S. Application Data

[63] Continuation-in-part of Ser. No. 862,676, Dec. 21, 1977, abandoned.

[30] Foreign Application Priority Data

Dec. 23, 1976 [DE] Fed. Rep. of Germany ..... 2658475

[51] Int. Cl.[2] ..... C23F 11/06; C23F 11/16

[52] U.S. Cl. ..... 422/13; 252/389 A; 422/15; 422/17

[58] Field of Search ..... 422/13, 15, 17; 252/389 A

[56] References Cited

U.S. PATENT DOCUMENTS

| | | | |
|---|---|---|---|
| 4,026,815 | 5/1977 | Kallfass et al. | 422/15 X |
| 4,042,324 | 8/1977 | Auel et al. | 422/15 |
| 4,052,160 | 10/1977 | Cook et al. | 422/15 |
| 4,057,511 | 11/1977 | Bohnsack et al. | 422/18 X |

*Primary Examiner*—Barry S. Richman
*Attorney, Agent, or Firm*—Hammond & Littell, Weissenberger & Muserlian

[57] ABSTRACT

A method of inhibiting the corrosion of aluminum in contact with an alkaline solution comprising adding 2-phosphono-butane-1,2,4-tricarboxylic acid or a water-soluble salt thereof as inhibitor to the alkaline solution.

6 Claims, No Drawings

METHOD OF INHIBITING CORROSION OF ALUMINUM WITH 2-PHOSPHONO-BUTANE-1,2,4-TRICARBOXYLIC ACID

REFERENCE TO PRIOR APPLICATION

This application is a continuation-in-part of Ser. No. 862,676, filed Dec. 21, 1977 and now abandoned.

FIELD OF THE INVENTION

The invention relates to a method of inhibiting the corrosion of aluminum in contact with alkaline solutions by adding 2-phosphono-butane-1,2,4-tricarboxylic acid or a water-soluble salt thereof as inhibitor to the alkaline solution.

BACKGROUND OF THE INVENTION

It is known to use oxidation agents such as, for example, permanganate and chromates for the purpose of inhibiting the corrosion of aluminum in alkaline solutions. The degree of effectiveness of such oxidation agents is, however, low, so that relatively large quantities must be used. Today, chromates can practically no longer be used for safety and ecological reasons involving the work environment and effluent treatment.

The use of water glass (sodium silicate) as an inhibitor for aluminum in alkaline solutions is also known. Good results are achieved with water glass if it is used in appropriately large quantities. It has, however, been shown that the necessarily large addition of water glass to alkaline solutions often leads to unpleasant accompanying phenomena. For example, incrustations and coatings occur on the parts which have been treated with the solutions, especially if these parts are subsequently treated with acid in order to remove excess alkali. Such incrustations and coatings are not attacked by conventional de-scaling solutions. Their removal is in practice only possible by means of hydrofluoric acid and is thus complicated and not without its problems.

It has already been proposed to use 1-amino alkane 1,1-diphosphonic acid as an inhibitor for aluminum in alkaline solutions. Good results can thereby be achieved but, from the standpoint of effluent treatment, it is, however, desirable to use compounds whose phosphorus and nitrogen content is as low as possible.

OBJECTS OF THE INVENTION

An object of the present invention is the development of a process for inhibiting the corrosion of aluminum by alkaline solutions without the use of compounds having excessively high phosphorus and nitrogen contents, thereby facilitating effluent treatment.

Another object of the present invention is the development of a process which slows down the attack of alkaline solutions on aluminum and prevents the formation on the aluminum of difficultly removable incrustations and coatings.

A further object of the present invention is the development of a method for inhibiting the corrosion of aluminum in contact with an alkaline solution comprising adding to the alkaline solution in contact with aluminum from 0.05 to 0.4 gm/l of 2-phosphono-butane-1,2,4-tricarboxylic acid or a water-soluble salt thereof.

These and other objects of the invention will become more apparent as the description thereof proceeds.

DESCRIPTION OF THE INVENTION

According to the present invention there is provided a method for reducing or substantially preventing corrosion of aluminum by alkaline solutions, which comprises adding to the alkaline solution an effective amount of 2-phosphono-butane-1,2,4-tricarboxylic acid or a water-soluble salt thereof as inhibitor to the alkaline solution.

More particularly, the present invention relates to a method for inhibiting the corrosion of aluminum in contact with aqueous alkaline solutions comprising adding to the aqueous alkaline solution in contact with aluminum from 0.05 to 0.4 gm/l of 2-phosphono-butane-1,2,4-tricarboxylic acid or a water-soluble salt thereof.

The preferred water-soluble salts of 2-phosphono-butane-1,2,4-tricarboxylic acid to be used as inhibitors in accordance with the invention are the sodium, potassium and ammonium salts.

2-phosphono-butane-1,2,4-tricarboxylic acid is particularly effective at relatively low inhibitor concentrations in alkaline solutions. Accordingly, the quantities of 2-phosphono-butane-1,2,4-tricarboxylic acid that are administered to the alkaline solutions for inhibiting corrosion lie in the range from 0.05 to 0.4 gm/l, preferably 0.08 to 0.2 gm/l.

The extraordinarily good corrosion-inhibiting effect of the 2-phosphono-butane-1,2,4-tricarboxylic acid or salts of the invention is surprising in that if in their place equal quantities of alkali metal silicate are used, the inhibition is then found to be completely insufficient. The special effectiveness with respect to inhibition possessed by 2phosphono-butane-1,2,4-tricarboxylic acid and its water-soluble salts is further brought out by the fact that substantially poorer results are obtained using other compounds of similar structure such as, for example, 1,2-diphosphonoethane-1,2-dicarboxylic acid dihydrate and α-phosphono-propionic acid.

The corrosion inhibitor of the invention can be manufactured in known manner and can be used in accordance with the process of the invention in aqueous alkaline solutions which contain the other conventional additives used in such corrosion inhibitory media. The invention relates also to the corrosion inhibitory aqueous alkaline solution in contact with aluminum comprising an effective amount of 2-phosphono-butane-1,2,4-tricarboxylic acid or a water-soluble salt thereof as inhibitor and the other conventional additives present in such corrosion inhibitory compositions.

The inhibitors of the invention are principally effective in alkali metal carbonate solutions, such as in particular sodium carbonate solutions and have quite good effectiveness as well in solutions which contain sodium or potassium hydroxide. By use of the inhibitors of the invention, the attack of alkaline solutions on aluminum is slowed down and a control on material losses is thereby achieved to a degree which is especially suitable in practical applications.

At the same time, the process of the invention avoids the formation of coatings and incrustations which has lead to difficulties in the case of the previously use alkali metal silicate inhibitors. And, as already mentioned above, use of the corrosion inhibitors of the invention has the furhter advantage that effluent treatment is thereby facilitated.

It is, of course, to be understood that the effectiveness of 2-phosphono-butane-1,2,4-tricarboxylic acid and its salts in inhibiting corrosion can be reduced in a severely corrosive alkaline solution. Routine experimentation by one skilled in the art can readily establish limitations on the effectiveness of the corrosion-inhibiting agents of the invention caused by such highly corrosive systems. As a general rule, the aqueous alkaline solutions in contact with aluminum to be treated by the inhibitors of the invention have a pH at 20° C. of 14.0 or below. Since the solubility of aluminum in aqueous solutions is low until a pH of 9 is exceeded, the aqueous alkaline solutions in contact with aluminum, usually treated by the inhibitors of the invention, have a pH at 20° C. in the range of from 10 to 14. A normal sodium hydroxide solution (40 gm/l) has a pH of 14 and a 0.01 N solution has a pH of 12.

EXAMPLES

Aqueous solutions were prepared which each contained 10 gm/l of anhydrous sodium carbonate or sodium hydroxide or potassium hydroxide as well as the quantity of 2-phosphono-butane-1,2,4-tricarboxylic acid indicated in the following Tables 1–3. A 1 $dm^2$ large, degreased and weighed test piece of 99.7% aluminum with a thickness of 1 mm was exposed to the action of each of these solutions for 60 minutes at 50° C. The test pieces were then washed, dried and weighed in order to determine the loss in aluminum.

For the purposes of comparison, aluminum test pieces were treated under the same conditions with solutions which, in addition to 10 gm/l of anhydrous sodium carbonate or sodium hydroxide or potassium hydroxide, contained the following in the quantities shown in each case (in the column headed "Quantity of Inhibitor in mg/l").

(a) no inhibitor
(b) α-phosphonopropionic acid
(c) hydroxypropane diphosphonic acid
(d) 1,2-diphosphonoethane-1,2-dicarboxylic acid dihydrate
(e) phosphonosuccinic acid
(f) α-methylphosphonosuccinic acid
(g) β-phosphono-pentane-1,3,5-tricarboxylic acid The results obtained are given in the following Tables 1 to 3. The protective value given in column 2 of the Tables was calculated according to the following formula:

$$S\,\% = \left(1 - \frac{\text{material removed with inhibitor}}{\text{material removed without inhibitor}}\right) \times 100$$

In order to obtain a protective value of 98–100% with sodium silicate (water glass) in the presence of a sodium carbonate concentration of 10 gm/l, an inhibitor concentration of 400–500 mg/l must be present. In the presence of this amount of sodium hydroxide, sodium silicate quantities of 11–12 gm/l are required and in the presence of this amount of potassium hydroxide, sodium silicate quantities of 9–10 gm/l are required.

TABLE 1

Corrosion of aluminum in sodium carbonate solution (10 gm/l) at 50° C.

| | Inhibitor | Quantity of Inhibitor in mg/l | Protective value (S) % |
|---|---|---|---|
| a | no inhibitor | 0 | 0 |
| b | α-phosphonopropionic acid | 100 | 8 |
| | | 150 | 13 |
| | | 300 | 35 |
| c | hydroxypropane diphosphonic acid | 100 | 93 |
| | | 150 | 95 |
| | | 300 | 92 |
| d | 1,2-diphosphonoethane-1,2-dicarboxylic acid dihydrate | 100 | 54 |
| | | 150 | 62 |
| | | 300 | 62 |
| e | phosphonosuccinic acid | 100 | 27 |
| | | 150 | 35 |
| | | 300 | 60 |
| f | α-methylphosphonosuccinic acid | 100 | 49 |
| | | 150 | 54 |
| | | 300 | 77 |
| g | β-phosphono-pentane-1,3,5-tricarboxylic acid | 100 | 26 |
| | | 150 | 31 |
| | | 300 | 43 |
| | 2-phosphono-butane-1,2,4-tricarboxylic acid | 80 | 100 |
| | | 100 | 100 |
| | | 150 | 100 |
| | | 300 | 100 |

TABLE 2

Corrosion of aluminum in sodium hydroxide solution (10 gm/l) at 50° C.

| | Inhibitor | Quantity of Inhibitor in mg/l | Protective value (S) % |
|---|---|---|---|
| a | no inhibitor | 0 | 0 |
| b | α-phosphonopropionic acid | 100 | 34 |
| | | 150 | 47 |
| | | 300 | 69 |
| c | hydroxypropane diphosphonic acid | 100 | 15 |
| | | 150 | 85 |
| | | 300 | 89 |
| d | 1,2-diphosphonoethane-1,2-dicarboxylic acid dihydrate | 100 | 14 |
| | | 150 | 26 |
| | | 300 | 35 |
| | 2-phosphono-butane-1,2,4-tricarboxylic acid | 100 | 98 |
| | | 150 | 98 |
| | | 300 | 99 |

TABLE 3

Corrosion of aluminum in potassium hydroxide solution (10 gm/l) at 50° C.

| | Inhibitor | Quantity of Inhibitor in mg/l | Protective value (S) % |
|---|---|---|---|
| a | no inhibitor | 0 | 0 |
| b | α-phosphonopropionic acid | 100 | 41 |
| | | 150 | 48 |
| | | 300 | 71 |
| c | hydroxypropane diphosphonic acid | 100 | 71 |
| | | 150 | 78 |
| | | 300 | 87 |
| d | 1,2-diphosphonoethane-1,2-dicarboxylic acid dihydrate | 100 | 35 |
| | | 150 | 53 |
| | | 300 | 42 |
| | 2-phosphono-butane-1,2,4,-tricarboxylic acid | 100 | 98 |
| | | 150 | 99 |
| | | 300 | 99 |

As can be seen from the test results in Tables 1–3, the corrosion inhibitor of the invention, when present at concentrations of only 80–300 mg/l, provided protective values of 98–100%. To achieve this same level of protection with sodium silicate requires much higher inhibitor concentrations (See the above paragraph from page 7–8). The test results also show that similar compounds, such as 1,2-diphosphonoethane-1,2-dicarboxylic acid dihydrate, phosphono-succinic acid, α-methylphosphonosuccinic acid, β-phosphono-pentane-1,3,5-tricarboxylic acid and α-phosphonopropionic acid, provide substantially less protection. The protection values achieved with the corrosion inhibitor of the invention demonstrate that it can function as an extremely potent agent in inhibiting the corrosion of aluminum by alkaline solutions, especially those having a pH at 20° C. of between 10 and 14.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A method for inhibiting the corrosion of aluminum in contact with aqueous alkaline solutions having a pH at 20° C. of from 10 to 14 consisting essentially of adding to the aqueous alkaline solution in contact with aluminum from 0.05 to 0.4 gm per liter of a corrosion inhibitor selected from the group consisting of 2-phosphono-butane-1,2,4-tricarboxylic acid and water-soluble salts thereof.

2. The method of claim 1 wherein the corrosion inhibitor is 2-phosphono-butane-1,2,4-tricarboxylic acid.

3. The method of claim 1 wherein the corrosion inhibitor is a water-soluble salt of 2-phosphono-butane-1,2,4-tricarboxylic acid selected from the group consisting of the sodium, potassium and ammonium salts.

4. The method of claim 1 wherein the corrosion inhibitor is present in the aqueous alkaline solution in a concentration of 0.08 to 0.2 gm per liter.

5. The method of claim 1 wherein the aqueous alkaline solution contains a member selected from the group consisting of sodium carbonate, sodium hydroxide, potassium hydroxide, and mixtures thereof.

6. The method of claim 1 wherein the aqueous alkaline solution contains sodium carbonate.

* * * * *

UNITED STATES PATENT AND TRADEMARK OFFICE

CERTIFICATE OF CORRECTION

PATENT NO. : 4,229,409

DATED : October 21, 1980

INVENTOR(S) : ROLF SCHARF ET AL.

It is certified that error appears in the above—identified patent and that said Letters Patent is hereby corrected as shown below:

Column 2, line 33: "2phosphono" should read -- 2-phosphono --.

line 61: "use" should read -- used --.

line 64: "furhter" should read -- further --.

Column 3, line 9: "unitl" should read -- until --.

Signed and Sealed this

*Eleventh* Day of *August* 1980

[SEAL]

*Attest:*

GERALD J. MOSSINGHOFF

*Attesting Officer*

*Commissioner of Patents and Trademarks*